US007477127B2

(12) United States Patent
Kamijima

(10) Patent No.: US 7,477,127 B2
(45) Date of Patent: Jan. 13, 2009

(54) ELECTRONIC DEVICE HAVING ORGANIC MATERIAL BASED INSULATING LAYER AND METHOD FOR FABRICATING THE SAME

(75) Inventor: Akifumi Kamijima, Tokyo (JP)

(73) Assignee: TDK Corporation, Tokyo (JP)

( * ) Notice: Subject to any disclaimer, the term of this patent is extended or adjusted under 35 U.S.C. 154(b) by 393 days.

(21) Appl. No.: 11/237,982

(22) Filed: Sep. 29, 2005

(65) Prior Publication Data

US 2006/0068602 A1 Mar. 30, 2006

(30) Foreign Application Priority Data

Sep. 30, 2004 (JP) ..... 2004-286887

(51) Int. Cl.
*H01F 27/30* (2006.01)

(52) U.S. Cl. ..... 336/206

(58) Field of Classification Search ..... 336/65, 336/83, 200, 206–208, 232; 257/531
See application file for complete search history.

(56) References Cited

U.S. PATENT DOCUMENTS

| | | | | |
|---|---|---|---|---|
| 6,414,818 | B1 | 7/2002 | Tanimoto et al. | |
| 6,476,485 | B1 * | 11/2002 | Sato | 257/737 |
| 6,490,128 | B1 * | 12/2002 | Sato | 360/125.68 |
| 6,710,694 | B2 * | 3/2004 | Matsuta et al. | 336/200 |
| 6,721,130 | B2 | 4/2004 | Yazawa et al. | |
| 7,145,427 | B2 * | 12/2006 | Yoshida et al. | 336/200 |
| 7,253,713 | B2 * | 8/2007 | Tomonari et al. | 336/200 |
| 2005/0003199 | A1 | 1/2005 | Takaya et al. | |
| 2005/0164520 | A1 * | 7/2005 | Muraneka et al. | 438/778 |

FOREIGN PATENT DOCUMENTS

| | | |
|---|---|---|
| JP | A-05-290325 | 11/1993 |
| JP | 7-296329 A | 11/1995 |
| JP | 2000-114045 A | 4/2000 |
| JP | A-2000-114041 | 4/2000 |
| JP | A-2000-150238 | 5/2000 |
| JP | A-2000-294443 | 10/2000 |
| JP | A-2000-306215 | 11/2000 |
| JP | A-2002-123910 | 4/2002 |
| JP | A-2003-289231 | 10/2003 |
| JP | A-2004-221572 | 8/2004 |
| JP | A-2005-109082 | 4/2005 |
| JP | A-2005-109083 | 4/2005 |
| JP | A-2005-150329 | 6/2005 |

* cited by examiner

*Primary Examiner*—Tuyen T. Nguyen
(74) *Attorney, Agent, or Firm*—Oliff & Berridge, PLC

(57) ABSTRACT

In an electronic device, insulating layers (24, 26 and 28) on metal conductors (23 and 27) situated inside the device are formed of insulating layers made of a novolac resin, and an insulating layer made of a polyimide resin is used as an insulating layer (30) covering these insulating layers and exposed on the surface of the device. Development can be prevented in the case where a portion of each of the insulating layers (24, 26 and 28) is opened to expose a metal conductor, and rework can also be easily carried out. The use of an insulating layer made of a polyimide resin as the insulating layer (30) exposed on the surface of the device provides excellent weather resistance and reliability.

7 Claims, 4 Drawing Sheets

ELECTRONIC DEVICE HAVING ORGANIC MATERIAL BASED INSULATING LAYER AND METHOD FOR FABRICATING THE SAME

This Application is an U.S. Nonprovisional Utility Patent Application that claims priority from Japanese Patent Application No. 2004-286887 filed Sep. 30, 2004, the complete disclosure of which is incorporated herein by reference.

BACKGROUND OF THE INVENTION

1. Field of the Invention

The present invention relates to electronic devices each having at least one organic material based insulating layer, in particular, electronic devices, each having at least one organic material based insulating layer, excellent in weather resistance and reliability, in spite that a portion of the insulating layer is exposed on the surface of the device, and also having easiness in fabrication and reworkability.

2. Description of the Related Art

As electronic instruments such as personal computers and cellular phones are reduced in size, electronic parts such as coils and capacitors mounted in the interior of electronic instruments are required to be reduced in size or to be formed in thin films.

For example, a thin film magnetic head includes a multilayer lamination of thin film layers such as magnetic films and insulating layers, and further includes coil conductors formed therein. A thin film inductor also has a structure in which a substrate is provided, on the outer surface thereof, with electrodes to be connected to external circuits, and a conductor to work as a self-inductance is provided inside the substrate in a manner covered with insulating layers.

As the insulating layers in such a thin film magnetic head and such a thin film inductor, insulating layers made of inorganic materials such as $SiO_2$ and insulating layers made of organic materials such as novolac resin and polyimide resin have hitherto been known (Japanese Patent Laid-Open No. 2000-114045). Among these insulating layers, insulating layers made of organic materials are used particularly for applications to thin film magnetic heads and thin film inductors in which heat treatment at high temperatures affects the specific resistances of magnetic layers, because by use of organic materials, such insulating layers are able to be made at relatively low temperatures and thick insulating layers are able to be made easily.

For example, in Japanese Patent Laid-Open No. 7-296329, a first insulating layer made of polyimide and a second insulating layer made of a novolac resin are used in a laminated manner. This case discloses that the use of the polyimide insulating layer having a high volume resistivity permits attaining a higher improvement of the insulating properties than a single use of the novolac resin; and the novolac resin participating in lamination reduces a risk of the break of the coil conductor in the peripheral areas of the insulating layers as compared to the case where the polyimide resin is used alone because the shape of the cured film made of the novolac resin is smooth. Also in this case, a coil conductor is formed on the laminated insulating layer to fabricate a thin film magnetic head.

The metal constituting the coil conductor is a relatively easily ionizable metal material such as copper (Cu). Consequently, when a photosensitive polyimide is used for an insulating layer covering the coil conductor, unless the coil conductor made of Cu is covered with Ni or the like and then the covering insulating layer is formed, there occurs a problem that Cu ions penetrate into the photosensitive polyimide to form a Cu complex with the polyimide. The formation of such a Cu complex causes development failure in the development after exposure to prevent obtaining a desired pattern. In particular, such development failure causes a problem when patterns such as contact holes are formed on the polyimide layer covering a conductor.

Also, in the course of fabrication, when a desired pattern is not obtained due to a pattern failure, a procedure of rework in which the failed resin pattern is peeled off and the resin concerned is again applied to form the pattern is adopted as the case may be; herein involved is a problem that polyimide is excellent in weather resistance and accordingly poor in reworkability.

As disclosed in the above Japanese Patent Laid-Open No. 7-296329, the use of a laminate structure composed of a polyimide layer and a novolac resin layer permits attaining a certain level of reliability improvement due to polyimide and a certain level of workability due to a novolac resin. However, the present inventor has found that if a novolac resin is exposed on the surface of a device, the weather resistance of the device is drastically degraded.

SUMMARY OF THE INVENTION

An object of the present invention is to provide, by use of a novolac resin and a polyimide resin as the materials for insulating layers, electronic devices which are excellent in weather resistance and reliability in spite that areas of the insulating layers are exposed on the surface of the devices, and which are also low in price.

Another object of the present invention is to provide an organic material-based insulating layer structure excellent in reworkability by use of a novolac resin and a polyimide resin.

The present inventor has achieved the present invention on the basis of the idea, as described above, that insulating layers made of resin materials are formed by adopting an appropriate combination of a novolac resin and a polyimide resin so that the advantages of the novolac resin and the polyimide resin may be utilized and the disadvantages thereof may be compensated.

More specifically, the present invention includes the following aspects (1) to (11):

(1) An electronic device formed with at least a portion of an insulating layer exposed on the surface of the device, wherein the insulating layer comprising an insulating layer made of a novolac resin and an insulating layer made of a polyimide resin, the insulating layer made of the novolac resin forming an insulating layer on a metal conductor situated inside the device, a portion of which is opened to expose the metal conductor, and the insulating layer made of the polyimide resin used as the insulating layer exposed on the surface of the device.

(2) The electronic device according to the above (1), wherein the electronic device is a thin film magnetic device which has an insulating layer sandwiched by a pair of layers made of a magnetic material, the insulating layer comprising an insulating layer made of a novolac resin and an insulating layer made of a polyimide resin, the insulating layer with a coil conductor formed in a spiral shape embedded therein.

(3) The electronic device according to the above (2), wherein the thin film magnetic device is a thin film inductor.

(4) The electronic device according to the above (2), wherein the thin film magnetic device is a thin film magnetic head.

(5) The electronic device according to the above (2), wherein:

the thin film magnetic device is a common-mode choke coil comprising:

a first magnetic substrate made of a magnetic material;

a first insulating layer formed on the first magnetic substrate;

a second insulating layer formed on the first insulating layer;

a coil conductor embedded in the second insulating layer and formed in a spiral shape;

openings formed in the insulating layer on the inner periphery and the outer periphery of the coil conductor;

a magnetic layer formed by filling in at least the openings;

a second magnetic substrate fixed on the magnetic layer and made of a magnetic material; and terminal electrodes connected to the terminals of the coil conductor and disposed across the sides of the first and second magnetic substrates; wherein:

at least the second insulating layer comprises an insulating layer made of a novolac resin and an insulating layer made of a polyimide resin.

(6) The electronic device according to the above (5), wherein lead terminals are provided at least on any one of the upper layer and the lower layer of the coil conductor for the purpose of electrically connecting the coil conductor with the terminal electrodes; the insulating layer made of the novolac resin is interposed between the coil conductor and the lead terminals; and the coil conductor is connected with the lead terminals through contact holes formed in the insulating layer made of the novolac resin.

(7) The electronic device according to the above (1) to (6), wherein the metal conductor is covered with the insulating layer made of the novolac resin.

(8) A method for fabricating an electronic device which is formed with at least a portion of an insulating layer exposed on the surface of the device, the insulating layer comprising at least an insulating layer made of a novolac resin and an insulating layer made of a polyimide resin, the insulating layer made of the novolac resin formed on a metal conductor situated inside the device, and the insulating layer made of the novolac resin, a portion of which is opened to expose the metal conductor, the method comprising:

a step of forming the insulating layer made of the novolac resin in a shape which prevents the insulating layer from reaching the outer peripheral surface of the device, and a step of forming the insulating layer made of the polyimide resin as the insulating layer exposed on the surface of the device through covering the insulating layer made of the novolac resin formed in such a shape.

(9) The method for fabricating an electronic device according to the above (8), wherein the electronic device is a thin film magnetic device which comprises an insulating layer sandwiched by a pair of layers made of a magnetic material, the insulating layer including the insulating layer made of the novolac resin and the insulating layer made of the polyimide resin, the insulating layer with a coil conductor formed in a spiral shape embedded therein.

(10) The method for fabricating an electronic device according to the above (9), wherein:

the thin film magnetic device is a common-mode choke coil, and the method includes:

a step of forming a first insulating layer on a first magnetic substrate made of a magnetic material;

a step of forming a first lead terminal on the first insulating layer;

a step of applying a novolac resin constituting a portion of the second insulating layer on the first insulating layer and the first lead terminal and patterning the insulating layer made of the novolac resin in a shape which prevents the insulating layer from reaching the outer peripheral surface of the device, together with contact holes exposing a portion of the lead terminal;

a step of depositing a metal layer on the insulating layer made of the novolac resin and in the contact holes and forming a first coil conductor having at least a spiral pattern;

a step of applying the polyimide resin that constitutes a portion of the second insulating layer on the first coil conductor so as to cover the whole surface of the device and forming openings on the inner periphery and on the outer periphery of the coil conductor;

a step of forming a second coil conductor having at least a spiral pattern on the insulating layer made of the polyimide resin;

a step of applying the novolac resin that constitutes a portion of the second insulating layer on the insulating layer made of the polyimide resin and the second coil conductor and patterning the insulating layer made of the novolac resin in a shape which prevents the insulating layer from reaching the outer peripheral surface of the device, together with contact holes exposing a portion of the second coil conductor;

a step of depositing a metal layer on the insulating layer made of the novolac resin, in the contact holes and on the insulating layer made of the polyimide resin and forming a second lead terminal;

a step of applying the polyimide resin that constitutes a portion of the second insulating layer on the second lead terminal so as to cover the whole surface of the device and forming openings on the inner periphery and on the outer periphery of the coil conductor;

a step of forming a magnetic layer by filling in at least the openings;

a step of fixing a second magnetic substrate made of a magnetic material on the magnetic layer; and a step of disposing terminal electrodes across the sides of the first and second magnetic substrates, the terminal electrodes connected to the coil conductor through the lead terminals.

(11) The method for fabricating an electronic device according to the above (9), wherein:

the thin film magnetic device is a common-mode choke coil; and the method comprises:

a step of forming a first insulating layer on a first magnetic substrate made of a magnetic material;

a step of forming a lower lead terminal on the first insulating layer;

a step of applying the novolac resin that constitutes a portion of the second insulating layer on the first insulating layer and the lower lead terminal and patterning the insulating layer made of the novolac resin in a shape which prevents the insulating layer from reaching the outer peripheral surface of the device, together with patterning of contact holes exposing a portion of the lead terminal;

a step of depositing a metal layer on the insulating layer made of the novolac resin and in the contact holes and forming a first coil conductor having at least a spiral pattern;

a step of applying the novolac resin that constitutes a portion of the second insulating layer on the first coil conductor and patterning the novolac resin in a shape which prevents the layer from reaching the outer peripheral surface of the device;

a step of depositing a metal layer on the insulating layer made of the novolac resin and forming a second coil conductor having at least a spiral pattern;

a step of applying the novolac resin that constitutes a portion of the second insulating layer is formed on the insulating layer made of the novolac resin and the second coil conductor and patterning the insulating layer made of the novolac resin in a shape which prevents the insulating layer from reaching the outer peripheral surface of the device, together with contact holes exposing a portion of the second coil conductor;

a step of depositing a metal layer on the insulating layer made of the novolac resin and in the contact holes and forming an upper lead terminal to be connected to the lower lead terminal layer;

a step of applying the polyimide resin that constitutes a portion of the second insulating layer on the upper lead terminal so as to cover the whole surface of the device and forming openings on the inner periphery and on the outer periphery of the coil conductor;

a step of forming a magnetic layer by filling in at least the openings;

a step of fixing a second magnetic substrate made of a magnetic material on the magnetic layer; and a step of disposing terminal electrodes across the sides of the first and second magnetic substrates wherein the terminal electrodes are connected to the coil conductor through the lead terminals.

In the present invention, on completion of the fabrication of a device, the portion of the insulating layer which is finally to be the surface of the device is made of a polyimide film, and consequently the device is excellent in weather resistance and reliability, and the use of a novolac resin low in price and excellent in handling ability for a portion of the insulating layers facilitates the fabrication of the device.

The use of a novolac resin for areas needing sophisticated pattern, in particular, the pattern areas such as the contact holes formed on the metal conductors prevents the development failure; and the novolac resin is excellent in reworkability, and accordingly rework can be made easily and the process yield can thereby be improved.

DETAILED DESCRIPTION OF THE PREFERRED EMBODIMENTS

The novolac resin used in the present invention is typified by a resin obtained by condensation of phenol and formaldehyde, and collectively means such resins with various substituents introduced into the phenol moieties. In the present invention, photosensitive novolac resists which permit easy formation of patterns can be preferably used.

The polyimide resin used in the present invention means a substance obtained by thermosetting a polyimide precursor (polyamide acid) to form polyimide rings, and the types of the polyimide resin includes non-photosensitive polyimides, photosensitive polyimides with photosensitive groups introduced thereinto, and soluble polyimides. Examples of the photosensitive polyimides include an ester bond type photosensitive polyimide related to the polyimide precursor in which the photosensitive groups are esterically bonded to the carboxyl groups, and an ionic-coupling type photosensitive polyimide related to the polyimide precursor in which the photosensitive groups are ionically coupled to the carboxyl groups. It is the ionic-coupling type photosensitive polyimide that involves an apprehension that development failure is caused by complex formation with copper. The ester bond type photosensitive polyimide exerts a large stress, and sometimes cracks are generated when a thick film is formed thereof. However, because the use of a photosensitive polyimide as a polyimide resin facilitates the fabrication processes, the advantages of various polyimide resins are able to be individually displayed by optimizing the combinations of the polyimide resins with novolac resins.

Electronic devices compatible with the present invention are limited in such a way that the present invention sometimes cannot be adopted, from the viewpoint of heat resistance, for electronic devices which require relatively high temperature treatment such as impurity diffusion. Particularly when the present invention is applied to electronic devices involving magnetic materials such as thin film magnetic devices including thin film magnetic heads and thin film inductors, favorable results are obtained.

Now, the present invention will be described below with reference to a common-mode choke coil as a thin film magnetic device to which the present invention is applied.

FIGS. 1A to 1K are sectional flow diagrams schematically illustrating the steps for fabricating a chip common-mode choke coil according to a first embodiment of the present invention; in an actual fabrication, a plurality of devices are fabricated at the same time, but description is limited to one device in the present embodiment.

Figure 1A:
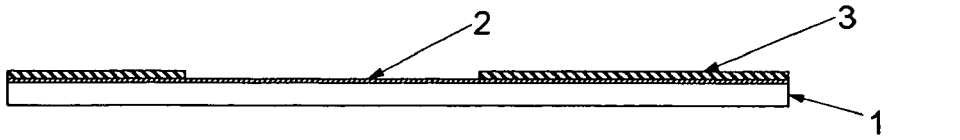
FIGS. 1A to 1K are sectional flow diagrams schematically illustrating the steps for fabricating a chip common-mode choke coil according to a first embodiment of the present invention.
Figure 1B:
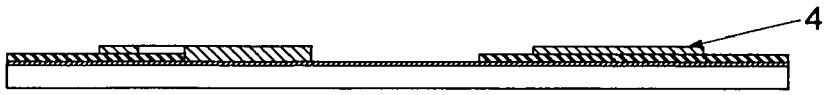
Figure 1C:
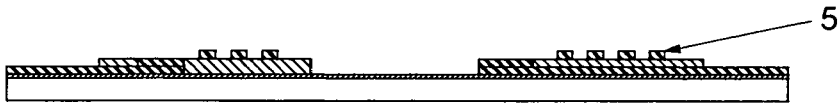
Figure 1D:
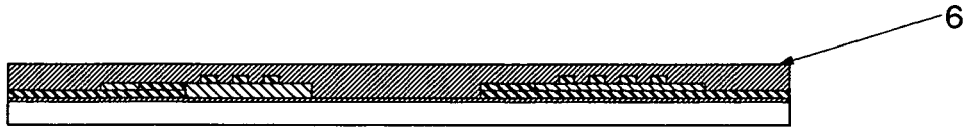
Figure 1E:
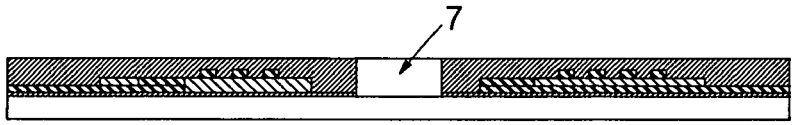
Figure 1F:
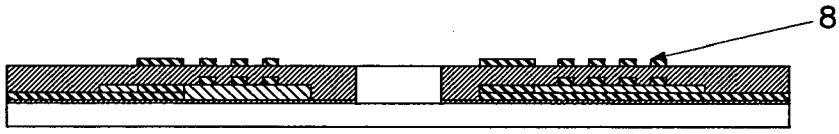
Figure 1G:
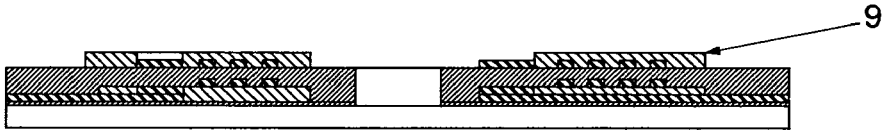
Figure 1H:
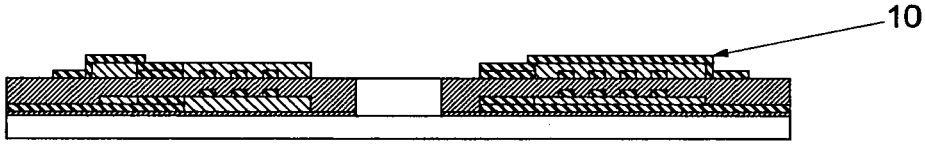
Figure 1I:
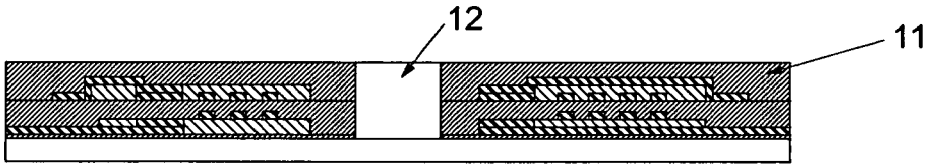
Figure 1J:
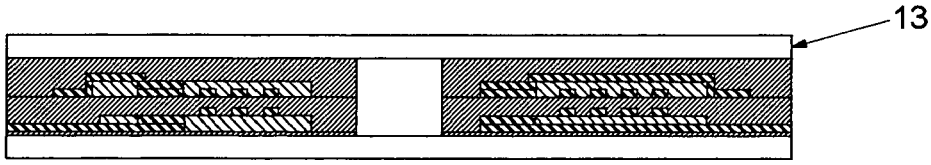
Figure 1K:
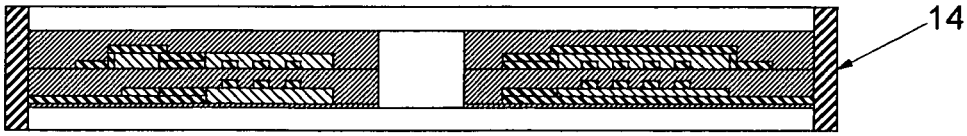

As shown in FIG. 1K, the chip common-mode choke coil according to the present embodiment is fabricated by integrally laminating the following members on the main surface of a first magnetic substrate 1 in the order of listing: an insulating layer 2 for controlling impedance, a first lead terminal layer 3, an insulating layer 4, a first coil conductor layer (spiral coil conductor pattern) 5, an insulating layer 6, a second coil conductor layer (spiral coil conductor pattern) 8, an insulating layer 9, a second lead terminal layer 10, an insulating layer 11, a magnetic layer 12 and a second magnetic substrate 13, with an electrode 14 provided on the side thereof.

The first magnetic substrate 1 and the second magnetic substrate 13 are made of a sintered ferrite, a compound ferrite or the like, the insulating layer 2 for controlling impedance is made of a material excellent in insulation properties and satisfactory in workability such as polyimide resin and epoxy resin. The insulating layers 4 and 9 are made of a novolac resin, and the insulating layers 6 and 11 are made of a polyimide. The first and second lead terminal layers 3 and 10, and the first and second coil conductor layers as spiral coil conductor patterns 5 and 8 are formed by a vacuum film formation method (an evaporation method, a sputtering method or the like) or a plating method using a metal; Cu, Al and the like are preferable, and Cu and Cu alloys can be particularly preferably used from the viewpoints of conductivity and workability. In the present embodiment, Cu is used. The magnetic layer 12 is made of a material in which a magnetic powder such as a ferrite powder is mixed in a resin such as epoxy resin.

In the fabrication of the chip common-mode choke coil, as shown in FIG. 1A, the insulating layer 2 for controlling impedance made of an insulating resin is formed in a thickness of 1 to 20 μm on the whole main surface of the first magnetic substrate 1. For the formation method concerned, application methods such as a spin coating method, a dip method, a spray method or a printing method, or a thin film formation method is adopted. In particular, the use of a thin film formation method makes it possible to form a film small in variation and high in precision for the insulating layer 2 for controlling impedance. Consequently, the variation of the impedance can be reduced.

Next, a metal film is formed on the insulating layer 2 for controlling impedance by a vacuum film formation method or a plating method to form the first lead terminal 3 having a desired shape of pattern. Examples of the patterning method that can be adopted may include a method in which after a metal film has been formed over the whole surface of the insulating layer 2 for controlling impedance, a desired pattern is formed by an etching method using well known photolithography, and an additive method in which a resist film is formed on the insulating layer 2 for controlling impedance, a pattern is formed by use of well known photolithography, and thereafter a metal film is formed within the pattern.

Next, on the first lead terminal 3, the insulating layer 4 made of a novolac resin is formed in a pattern shape. This pattern forms the central portion and the outer peripheral portion of the spiral pattern in the first coil conductor 5 to be formed in the next step, and the contact hole to connect the first lead terminal 3 and the first coil conductor 5 with each other (FIG. 1B).

Successively, the first coil conductor 5 as a spiral coil conductor pattern is formed (FIG. 1C). The formation method concerned is the same for the first lead terminal 3.

Next, the polyimide insulating layer 6 is formed over the whole surface of the device (FIG. 1D), a portion of a central area and the outer peripheral area (not shown) is removed from the spiral pattern of the first coil conductor 5, and thus a resin-removed area 7 is formed (FIG. 1E).

On the polyimide insulating layer 6 subjected to patterning, the second coil conductor 8 is formed as a spiral coil conductor pattern (FIG. 1F).

Next, similarly to FIG. 1B, the insulating layer 9 made of a novolac resin is formed in a pattern (FIG. 1G), and similarly to FIG. 1A, the second lead terminal 10 is formed (FIG. 1H).

Similarly to above FIGS. 1D and 1E, the polyimide insulating layer 11 is formed and patterned, and a magnetic powder-containing resin (to be the magnetic layer 12, when cured) is applied by a printing method from the upper surface of the insulating layer 11 in such a way that the resin-removed areas are also filled in. In FIG. 1I, the magnetic layer 12 is lapped until the insulating layer 11 is exposed, but the way of lapping is not limited to this case and it causes no problem if a part of the magnetic layer 12 remains on the insulating layer 11.

Onto the upper surfaces of the magnetic layer 12 and the insulating layer 11, the second magnetic substrate 13 is bonded through a not-shown adhesion layer (FIG. 1J).

Finally, as shown in FIG. 1K, the electrodes 14 are formed on the sides of the device to complete the common-mode choke coil.

Usually, in the steps until FIG. 1J, a plurality of chips are formed on one substrate, and after cutting into individual chips each having a shape of one device, the step of FIG. 1K is carried out.

In the first embodiment, the insulating layer made of the novolac resin is not exposed on the surface of the device; also for polyimide, the pattern formation involving polyimide is carried out only in the regions separated from the metal conductors, so that no development failure is caused.

FIGS. 2A to 2K are sectional flow diagrams schematically illustrating the steps for fabricating a chip common-mode choke coil according to a second embodiment of the present invention. In this embodiment, insulating layers 24, 26 and 28 sandwiching coil conductors 25 and 27 are made of a novolac resin, and finally the whole device is covered with a polyimide resin 30.

Figure 2A:
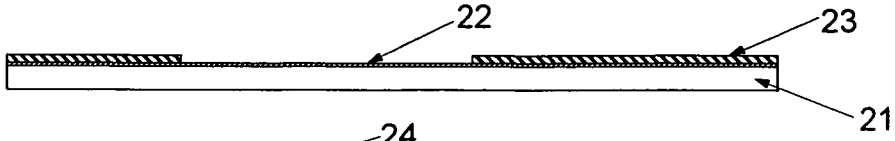
FIGS. 2A to 2K are sectional flow diagrams schematically illustrating the steps for fabricating a chip common-mode choke coil according to a second embodiment of the present invention.
Figure 2B:
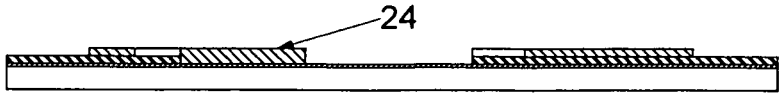
Figure 2C:
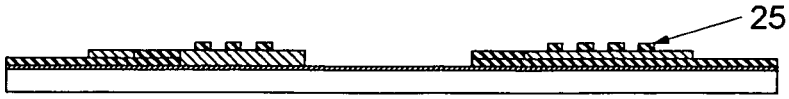

The steps from FIG. 2A to FIG. 2C are the same as those from FIG. 1A to FIG. 1C; reference numeral 21 denotes a first magnetic substrate, 22 an insulating layer for controlling impedance, 23 a lower lead terminal layer, 24 an insulating layer made of a novolac resin, and 25 a first coil conductor.

Figure 2D:
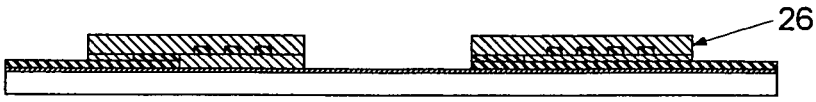
Figure 2E:
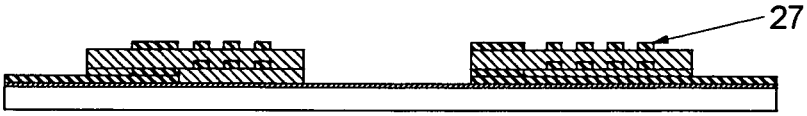
Figure 2F:
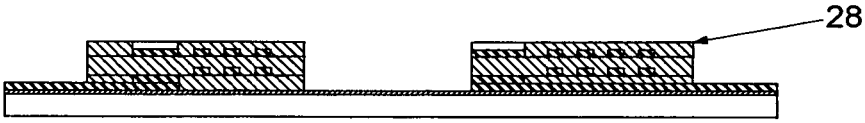
Figure 2G:
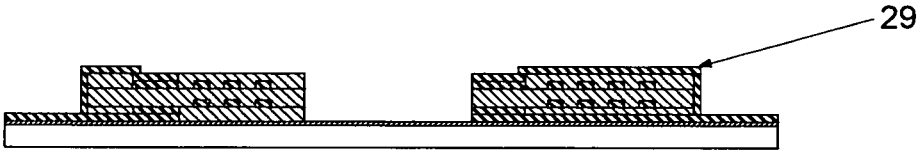

Next, as shown in FIG. 2D, a novolac resin is applied onto the coil conductor 25 and patterned to form the insulating layer 26. Successively, similarly to FIG. 2C, the second coil conductor 27 is formed (FIG. 2E), the insulating layer 27 made of a novolac resin is formed thereon in a desired pattern (FIG. 2F). As shown in FIG. 2G, an upper lead terminal layer 29 is formed.

Figure 2H:
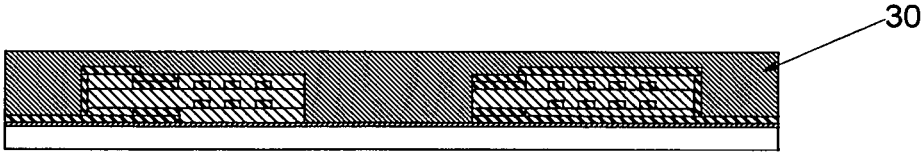
Figure 2I:
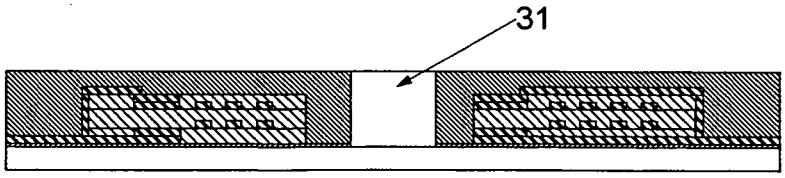
Figure 2J:
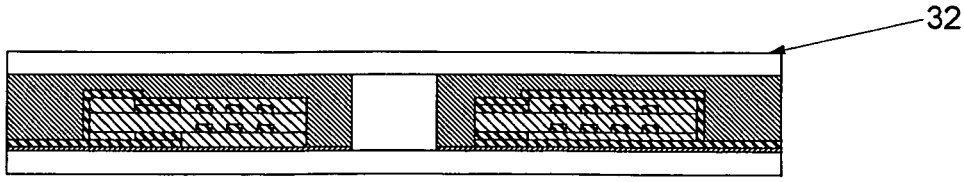
Figure 2K:
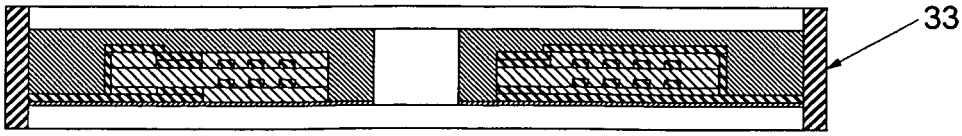
Figure 3:
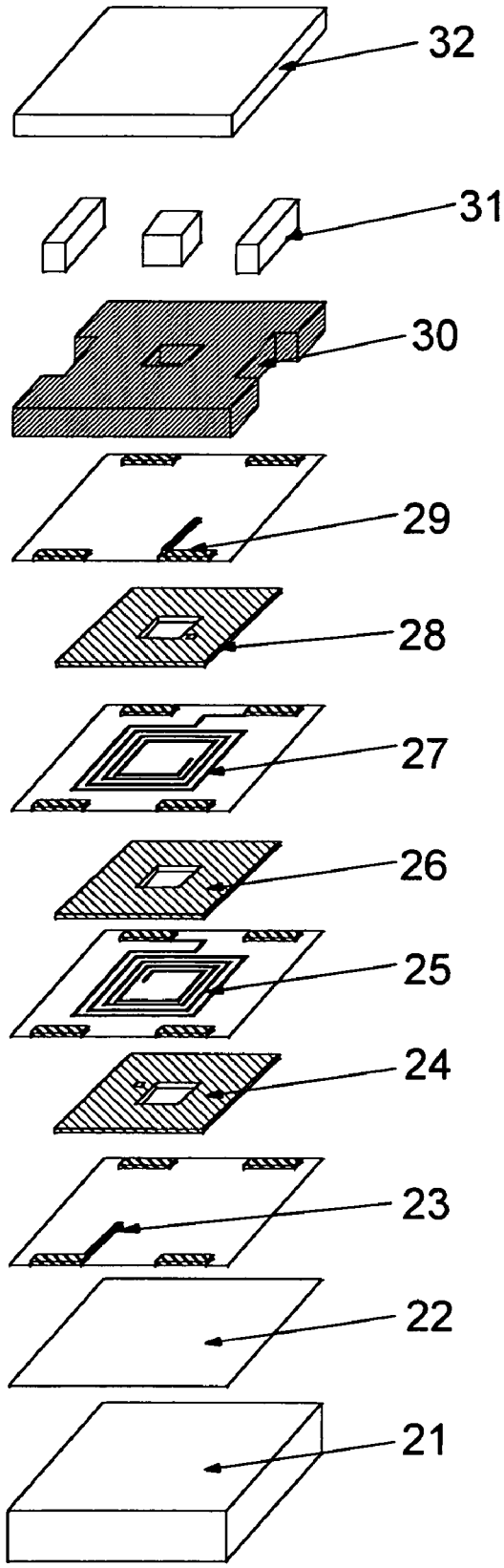
FIG. 3 is an exploded oblique perspective view of the chip common-mode choke coil illustrated in FIGS. 2A to 2K.
Figure 4:
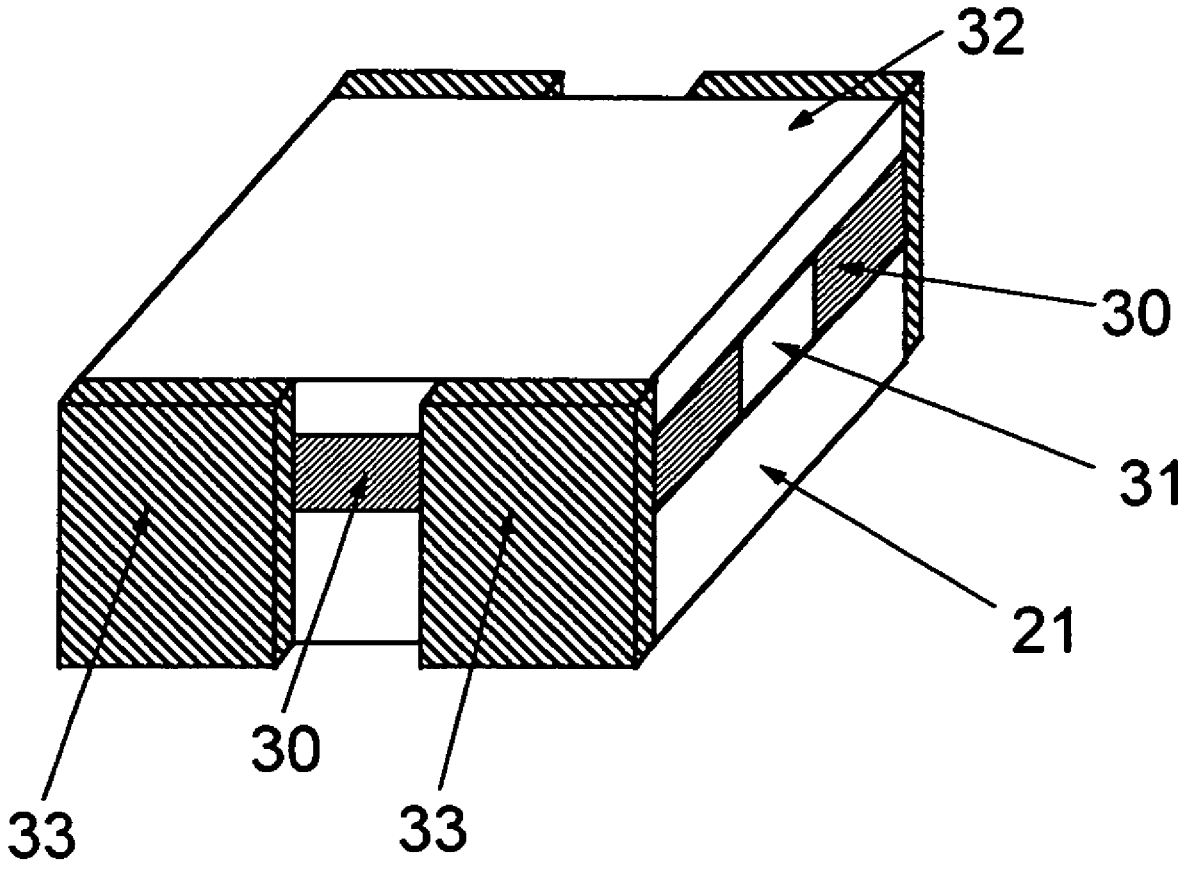
FIG. 4 is an oblique perspective view showing a completed chip common-mode choke coil.

Next, as shown in FIG. 2H, a polyimide insulating layer 30 is formed on the upper surface of the substrate 21, and as shown in FIG. 21, a portion of a central area and the outer peripheral area (not shown) is removed from of the spiral pattern of the coil conductor, and thus a magnetic layer 31 is formed by filling in. Thereonto, similarly to above FIGS. 1J and 1K, a second magnetic substrate 32 is bonded, and finally an electrode 33 is formed to complete the common-mode choke coil according to the present embodiment (FIGS. 2J and 2K). FIG. 3 shows an exploded oblique perspective view of the common-mode choke coil obtained by the second embodiment, and FIG. 4 shows an oblique perspective view of the completed common-mode choke coil. In FIG. 3, the electrode 33 finally formed is omitted; actually, as shown in FIG. 4, the electrode 33 is formed on each of the four positions so as to be in contact with the lead terminals 23 and 29; and the polyimide insulating layer 30 is exposed on the end faces on which the electrodes 33 are not formed.

In the second embodiment, the insulating layer made of the novolac resin is formed in a central area of the device, and contact holes to attain electric contact with the coil conductors and the like are formed in the insulating layer made of the novolac resin, so that development failure can be prevented. The whole device is covered with an insulating layer made of a polyimide resin, so that a device excellent in weather resistance and high in reliability is obtained. The pattern formation for the purpose of filling in the magnetic layer can be made by one step, so that the fabrication steps are simplified.

In the above embodiment, when a contact hole and the like are formed, sometimes the lower conductor and the hole deviate in position from each other. When only polyimide is used as insulating layer materials in conventional cases, rework is hardly conducted and products suffering from pattern deviation are thereby discarded. However, in the present invention, a novolac resin is used for the purpose of forming insulating layers in which contact holes are formed, so that when pattern deviation is caused, the formed novolac insulating layer can be easily removed by use of a special stripping liquid or by means of a plasma ashing, facilitating rework to form pattern through reapplying the resin.

Now, the present invention will be described below in detail with reference to an example, but it is understood that the present invention is not limited only to the example.

In the following example, the formation of the insulating layers by use of a polyimide resin and a novolac resin is carried out on the basis of the following methods.

A polyimide resin insulating layer was formed on the basis of the following method.

As a photosensitive polyimide, PHOTONEECE™ UK-5100 (manufactured by Toray Corp.) was applied onto a coil, for example, so as to have a thickness of 8 μm, heated with a hot plate at 100° C. for 10 minutes to prebake, and thereafter cooled down to room temperature.

Exposure (exposure apparatus: Canon PLA™ manufactured by Canon Co., Ltd.; exposure light wavelengths: Hg-broad band) was made through a mask, and the mask pattern was transferred as a latent image to a photosensitive polyimide. Heating was carried out at 90° C. for 3 minutes with a hot plate to cross-link the latent image area. Then, cooling down to room temperature was made.

Development was made with a developer containing 2-methylpyrrolidone, and rinsing was made with isopropyl alcohol.

In an atmosphere of nitrogen, the developed image was heated at 400° C. for 1 hour, to form a cured film (film thickness after curing: 4 μm on the coil).

A novolac resin insulating layer was formed on the basis of the following method.

A novolac resist (trade name: AZ-4000 series manufactured by Clariant Japan KK) was applied onto a coil, for example, so as to have a thickness of 6 μm, heated at 120° C. for 3 minutes with a hot plate to prebake, and thereafter cooled down to room temperature.

Exposure (exposure apparatus: Canon PLA™ manufactured by Canon Co., Ltd.; exposure light wavelengths: Hg-broad band) was made through a mask, and the mask pattern was transferred as a latent image to the novolac resist.

Development was made with a developer composed of an aqueous solution of tetramethylammonium hydroxide (TMAH), and rinsing was made with pure water.

In an atmosphere of nitrogen, the developed image was heated at 300° C. for 1 hour, to form a cured film (film thickness after curing: 4 μm on the coil).

EXAMPLE 1

According to the steps shown in FIGS. 2A to 2K, a chip common-mode choke coil was fabricated. In this Example, the insulating layer made of the novolac resin was not exposed on the surface of the device, but the insulating layer 30 made of the polyimide resin exposed on the surface of the device.

COMPARATIVE EXAMPLE 1

In the steps shown in FIGS. 2A to 2K, the insulating layers 26 and 28 were formed with a portion of the novolac resin exposed on the surface of the device.

COMPARATIVE EXAMPLE 2

According to the steps shown in FIGS. 2A to 2K, the insulating layer 30 was formed of the novolac resin.

COMPARATIVE EXAMPLE 3

According to the steps shown in FIGS. 2A to 2K, all the insulating layers were made of the polyimide resin. In the course of fabrication, sometimes the removal of the insulating layer on the conductor pattern was failed, and devices could not be fabricated. For reliability evaluation, only the articles succeeded in device formation were used.

Reliability Evaluation

The samples obtained in above Example 1 and Comparative Examples 1 to 3 were allowed to stand in an environment of 85° C. and a relative humidity of 85% for 1 month; thereafter, the samples exhibiting a coil resistance variation of 1% or more were evaluated as poor. The number of the samples per one condition was set at 1000, and the evaluation was given in terms of the proportion (%) of the poor samples, namely, the poor fraction (%).

Reworkability

Insulating layers after formation of contact hole pattern were removed by use of a special stripping liquid or by means of a plasma ashing, and the removal properties of the insulating layers were observed by visual inspection. The removal properties were evaluated in terms of the completeness degree of removal, namely, complete removal and incomplete removal indicated by the terms "Good" and "Poor," respectively in Table 1.

The results thus obtained are shown in Table 1.

TABLE 1

| | Reliability evaluation (Defect rate %) | Reworkability |
|---|---|---|
| Example 1 | 0.0 | Good |
| Comparative Example 1 | 92.8 | Good |
| Comparative Example 2 | 98.4 | Good |
| Comparative Example 3 | 0.0 | Poor |

As can be seen from Table 1, in Comparative Examples 1 and 2 in which the novolac resin was exposed on the surface of the device in each sample, the poor fractions are markedly large, and in Comparative Example 3 in which only the polyimide was used, the reworkability is poor.

In the above-described embodiments, description is made on the common-mode choke coil; however, the present invention is applicable to various purposes involving other thin film magnetic devices, as a matter of course, and chip semiconductor devices with an organic insulating layer exposed on the device surface and printed wiring boards.

What is claimed is:

1. An electronic device formed with at least a portion of an insulating layer exposed on the surface of the device, wherein:

the insulating layer comprising an insulating layer made of a novolac resin and an insulating layer made of a polyimide resin, the insulating layer made of the novolac resin is used as an insulating layer formed at least on a metal conductor situated inside the device, a portion of which is opened to expose the metal conductor, and formed in the shape which prevents the insulating layer from reaching the outer peripheral surface of the device; and the insulating layer made of the polyimide resin is used as the insulating layer exposed on the outer peripheral surface of the device with surrounding the insulating layer made of the novolac resin formed in said shape at least at the same layer level.

2. The electronic device according to claim 1, wherein:

the electronic device is a thin film magnetic device which has an insulating layer sandwiched by a pair of layers made of a magnetic material, the insulating layer comprising an insulating layer made of a novolac resin and an insulating layer made of a polyimide resin, the insulating layer with a coil conductor formed in a spiral shape embedded therein.

3. The electronic device according to claim 2, wherein the thin film magnetic device is a thin film inductor.

4. The electronic device according to claim 2, wherein the thin film magnetic device is a thin film magnetic head.

5. The electronic device according to claim 2, wherein:

the thin film magnetic device is a common-mode choke coil comprising:

a first magnetic substrate made of a magnetic material;

a first insulating layer formed on the first magnetic substrate;

a second insulating layer formed on the first insulating layer;

a coil conductor embedded in the second insulating layer and formed in a spiral shape;

openings formed in the insulating layer on the inner periphery and the outer periphery of the coil conductor;

a magnetic layer formed by filling in at least the openings;

a second magnetic substrate fixed on the magnetic layer and made of a magnetic material; and terminal electrodes connected to the terminals of the coil conductor and disposed across the sides of the first and second magnetic substrates; wherein:

at least the second insulating layer comprises an insulating layer made of a novolac resin and an insulating layer made of a polyimide resin.

6. The electronic device according to claim 5, wherein:

lead terminals are provided at least on any one of the upper layer and the lower layer of the coil conductor for the purpose of electrically connecting the coil conductor with the terminal electrodes; the insulating layer made of the novolac resin is interposed between the coil conductor and the lead terminals; and the coil conductor is connected with the lead terminals through contact holes formed in the insulating layer made of the novolac resin.

7. The electronic device according to claim 1, wherein the metal conductor is covered with the insulating layer made of the novolac resin.

* * * * *